US005749475A

United States Patent [19]

Krebs

[11] Patent Number: 5,749,475

[45] Date of Patent: May 12, 1998

[54] TIRE SUPPORT

[75] Inventor: Jimmy M. Krebs, Round Lake, Ill.

[73] Assignee: Benchmarc Display, Incorporated, Vernon Hills, Ill.

[21] Appl. No.: 822,063

[22] Filed: Mar. 24, 1997

[51] Int. Cl.[6] ..... A47F 7/00

[52] U.S. Cl. ..... 211/24; 211/175; 211/23

[58] Field of Search ..... 211/23, 24, 20, 211/175, 184, 43

[56] References Cited

U.S. PATENT DOCUMENTS

| | | | |
|---|---|---|---|
| 3,510,007 | 5/1970 | Walklet et al. | 211/24 |
| 4,106,735 | 8/1978 | Partain et al. | 211/43 X |
| 4,496,127 | 1/1985 | Nelson | 211/43 X |
| 4,550,835 | 11/1985 | Lynch | 211/24 |
| 4,856,659 | 8/1989 | Krebs | 211/24 |
| 4,874,099 | 10/1989 | Arnott et al. | 211/43 X |
| 5,137,160 | 8/1992 | Santucci | 211/175 X |
| 5,201,428 | 4/1993 | Pasinski et al. | 211/43 X |
| 5,295,596 | 3/1994 | Squitieri | 211/43 X |

*Primary Examiner*—Robert W. Gibson, Jr.
*Attorney, Agent, or Firm*—Douglas B. White

[57] ABSTRACT

The apparatus of this invention comprises first and second support members, wherein each support member includes horizontally extending legs and an upright portion. One leg of each support member is arranged to overlie a leg of the other support member, and locking tabs on the overlying legs insert and lock into notches of the underlying legs to interlock the supports.

13 Claims, 5 Drawing Sheets

TIRE SUPPORT

BACKGROUND OF THE INVENTION

1. Field of the Invention

This invention relates generally to display apparatus and more particularly to supports for displaying tires.

2. Description of the Prior Art

The prior art is exemplified by the tire supporting and display members described in U.S. Pat. No. 4,856,659, in which dual upright members are supported by horizontally extending legs. These upright members fit together with the horizontal legs overlapping to thereby form a freestanding support for a tire positioned therebetween. Once assembled, this structure provides secure support for a tire, with the weight of the tire on the legs keeping the apparatus together. Without the tire in place, however, the supports will have a tendency to separate.

SUMMARY OF THE INVENTION

It is accordingly the object of the present invention to provide an improvement to the prior art tire supports, which improvement interlocks the legs to keep the supports together in the absence of the weight of a tire.

The apparatus of this invention comprises identical first and second support members, wherein each support member includes horizontally extending legs and an upright portion affixed thereto. The legs of the support members are arranged to overlap and locking tabs on the overlying legs insert and lock into notches in the underlying legs to interlock the supports.

While the invention will be described in connection with a preferred embodiment, it will be understood that it is the intent to cover all alternatives, modifications, and equivalents as may be included within the spirit and scope of the invention as defined by the appended claims.

DESCRIPTION OF THE PREFERRED EMBODIMENT

Figure 1:
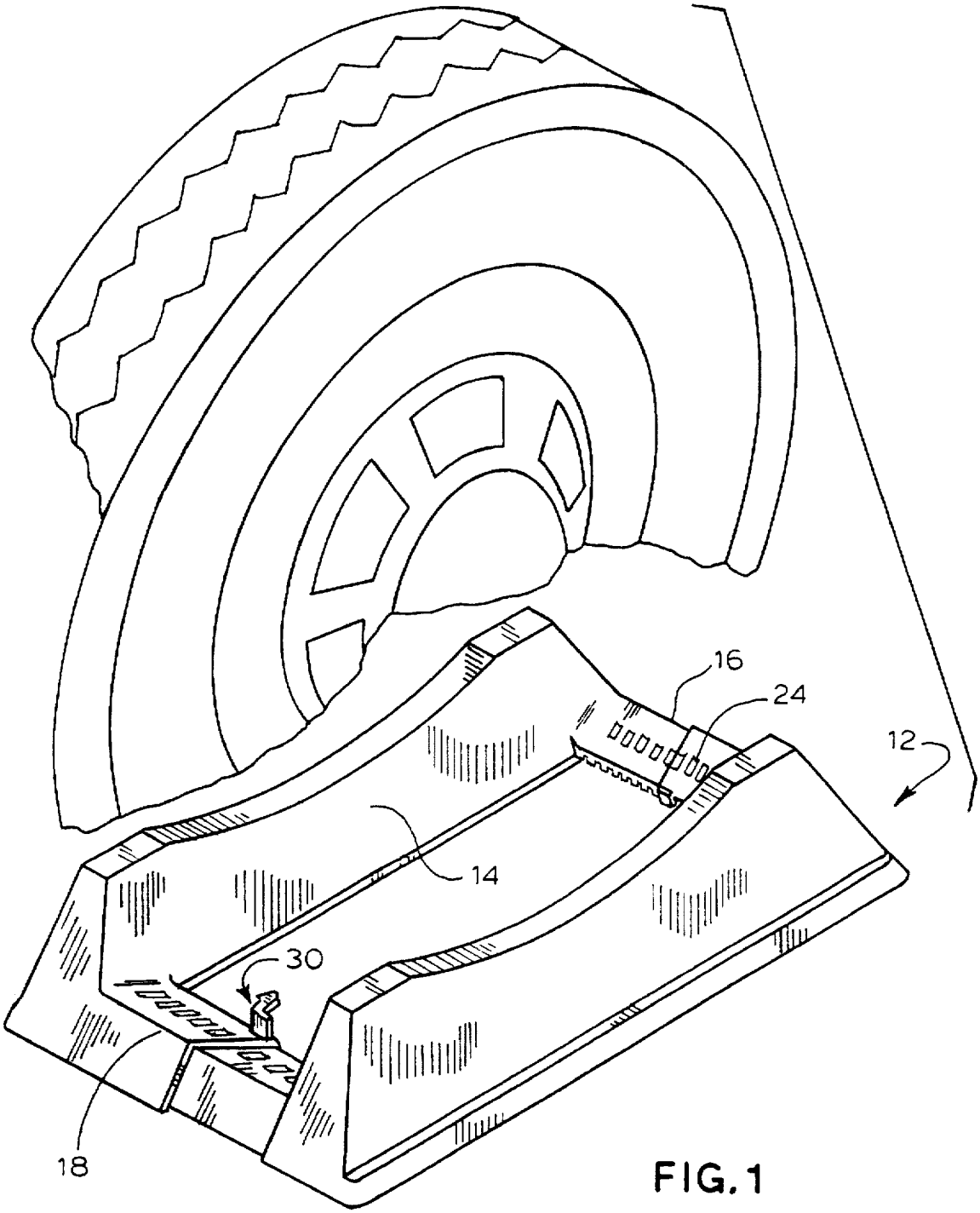
FIG. 1 is a perspective view of the tire support assembly of the invention, shown partially latched.

Turning first to FIG. 1 there is shown a tire support in accordance with the present invention. Paired support members 12 each include an upright portion 14 and integral horizontally extending legs 16 and 18. Each of the support members is identical in all respects and when paired, as shown in FIG. 1, the legs overlap and define a space between the legs and the upright portions for receipt of the tire to be displayed.

Figure 2:
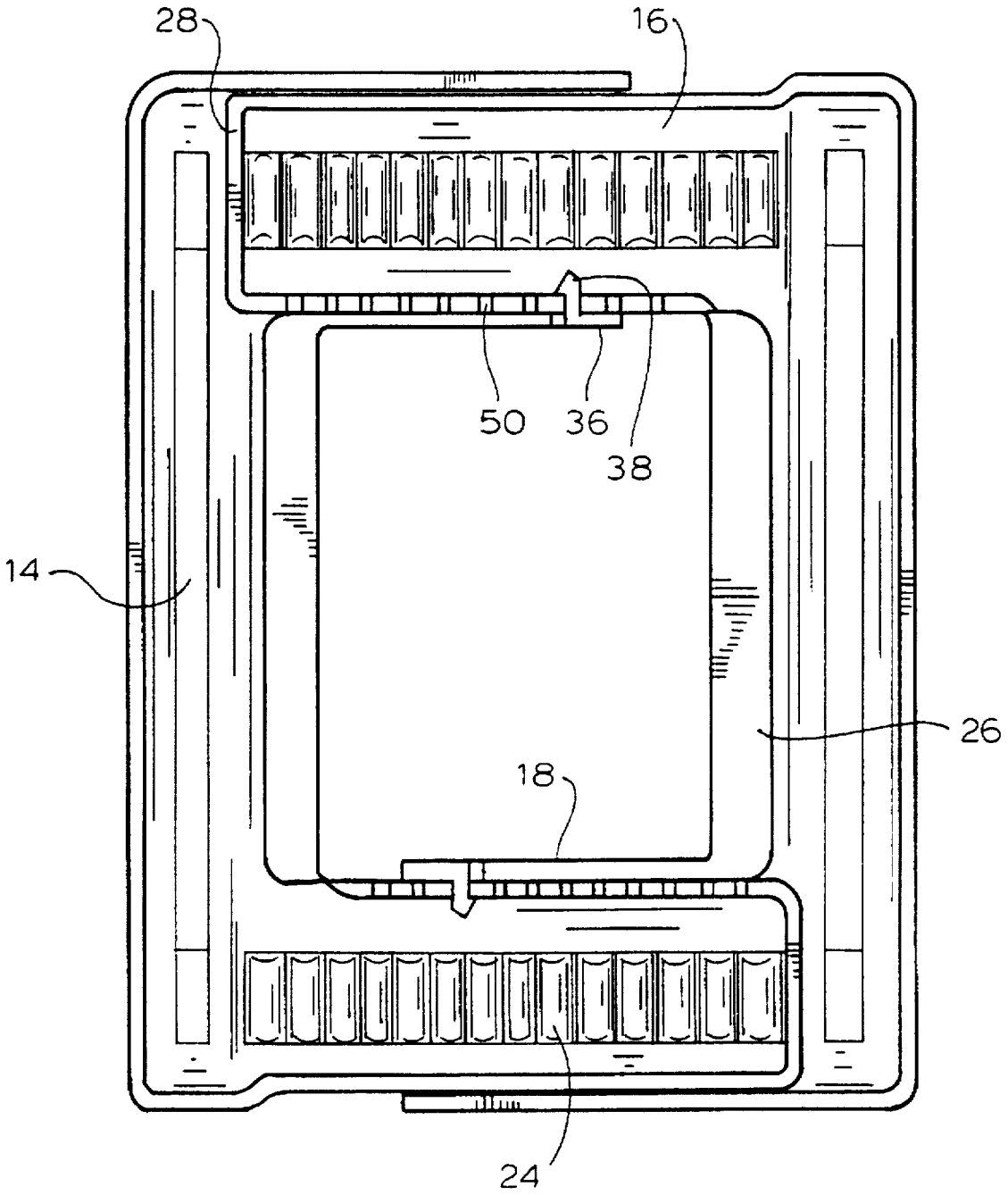
FIG. 2 is a bottom view of the support of FIG. 1, shown with both locking tabs engaged.
Figure 3:
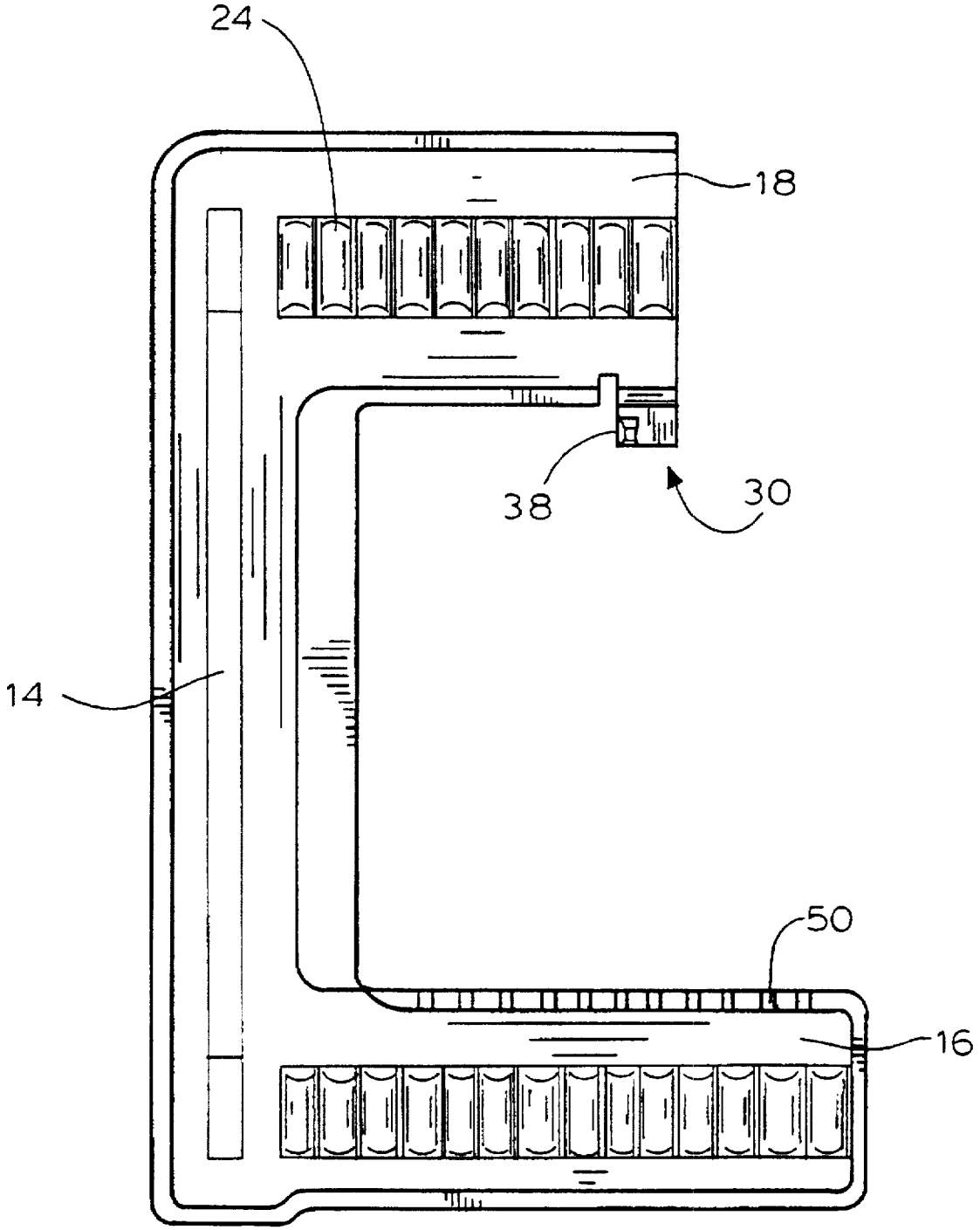
FIG. 3 is a bottom view of one of the pair of identical support members.
Figure 4:
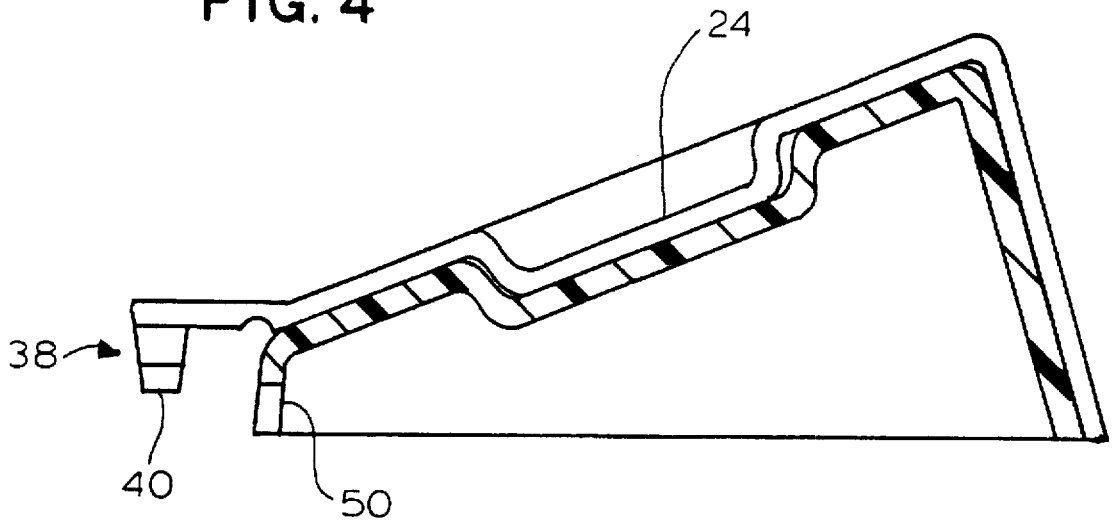
FIG. 4 is a cross section of the overlapped legs showing the interlocking tab in the unlocked position.

Positioning of the overlapping legs is facilitated through interlocking indentations 24 formed in each of the legs. When the indentations of overlapping legs are brought into registration they serve to correctly position the legs for locking engagement described below. Rigidity of the structure is enhanced by means of a reinforcing edge 26 (FIG. 2) spanning the horizontal legs and integral with the upright portions 14 of the support, as well as a transverse end wall 28 provided on the underlying leg 16. Finally, the legs are preferably trapezoidal in cross section with the surface of the legs being angled downwardly towards the center of the assembly (FIG. 1, FIG. 4 and FIG. 5) to provide stable supporting contact with the displayed tire.

Figure 5:
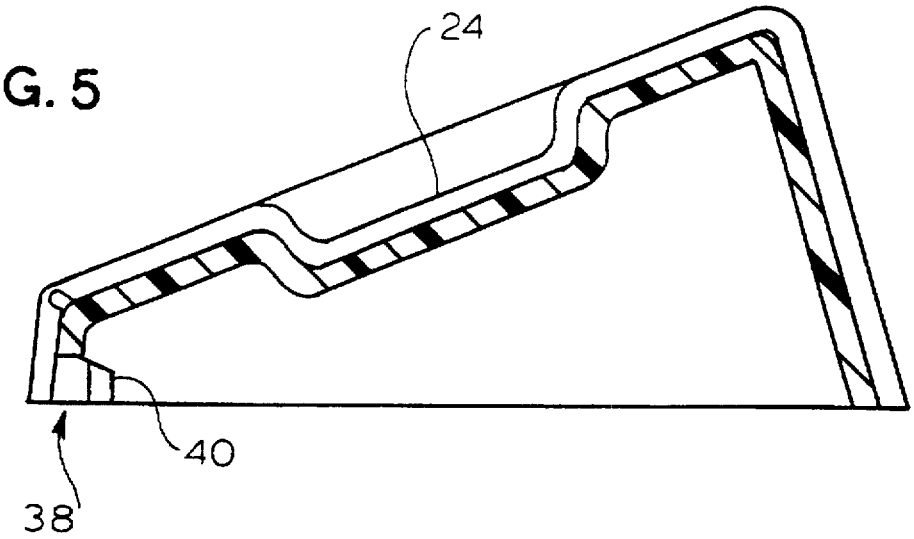
FIG. 5 is a cross section of the overlapped legs showing the interlocking tab in the locked position.
Figure 6:
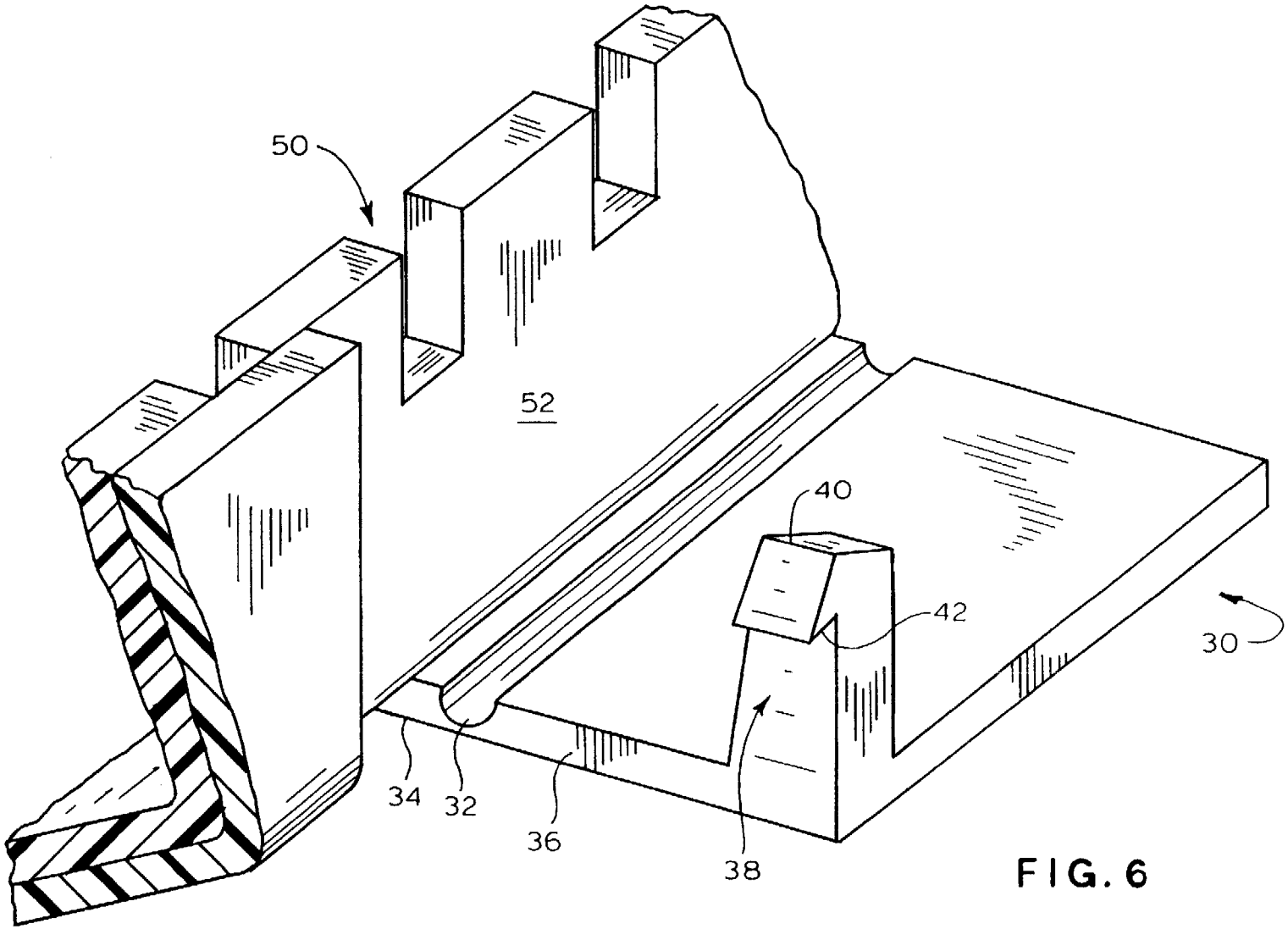
FIG. 6 is a perspective view of the locking tab feature, viewed from the bottom of the support apparatus.

Locking means for holding the supports in place without the weight of the tire includes the use of a tab device 30. This device utilizes a flexible hinge 32 (FIG. 6) formed as a thinned plastic section between the upper surface 34 of an overlying leg and a tab arm 36 attached thereto. A tapered solid block insert member 38 carried on the tab arm 36 presents a sharply tapered head 40 and a catch edge 42. Resilient notches 50 are positioned along the side 52 of the underlying leg for receipt of the tapered block insert member 38. Consequently, once the paired supports are positioned with the tab bearing legs overlying the notched legs, and the indentations are brought into registration (FIG. 4), the tab arm 36 is moved, by flexing the hinge 32, to force the tab insert 38 into the tab notch 50 (FIG. 5). The width of the notch 50 is preferably narrower than the width of the tab head 40 such that insertion of the tapered tab head forces the notch to yield while allowing the tab head to penetrate therethrough. Once the tab head passes through the notch, the resilient notch width reverts to its prior dimension and the catch edge 42 of the tab secures the tab (FIG. 2) within the notch.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A tire support assembly comprising:

first and second opposing support members, wherein each support member includes an upright portion and spaced first and second legs affixed to said upright portion, said legs extending horizontally therefrom in opposing relation to said legs extending from said opposing support member, whereby opposing legs overlap one another; and locking means for selectively fastening together said overlapped legs, wherein said locking means comprises tab means positioned on one of said overlapped legs and receptacle means positioned on said opposing overlapped leg for receipt of said tab means, said tab means comprising an arm member hinged to said respective leg and an insert member carried on said arm member.

2. The tire support assembly of claim 1 wherein said receptacle means comprises an opening defined in said respective leg for receipt of said insert member.

3. The tire support assembly of claim 2 wherein said insert member comprises a tapered block member having a catch edge defined thereon.

4. The tire support assembly of claim 3 wherein said receptacle means comprises a resilient notch.

5. The tire support assembly of claim 1 wherein said legs are substantially trapezoidal in cross section and each leg presents a sloping upper surface.

6. The tire support assembly of claim 5 wherein said receptacle means comprises an opening defined in said respective leg for receipt of said insert member.

7. The tire support assembly of claim 6 wherein said insert member comprises a tapered block member having a catch edge defined thereon.

8. The tire support assembly of claim 7 wherein said receptacle means comprises a resilient notch.

9. A support member for a tire support assembly comprising:

an upright portion;

first and second leg members extending horizontally from said upright portion; and tab means positioned on said first leg member and receptacle means positioned on said second leg member, wherein said tab means comprises an arm member hinged to said respective leg and an insert member carried on said arm member.

10. The support member for a tire support assembly of claim 9 wherein said insert member comprises a tapered block member having a catch edge defined thereon.

11. A support member for a tire support assembly comprising:

an upright portion;

first and second leg members extending horizontally from said upright portion, wherein said legs are substantially trapezoidal in cross section and each leg presents an upper sloping surface;

tab means positioned on said first leg member wherein said tab means comprises an arm member hinged to said respective leg and an insert member carried on said arm member; and receptacle means positioned on said second leg member.

12. The support member for a tire support assembly of claim 11 wherein said insert member comprises a tapered block member having a catch edge defined thereon.

13. The support member for a tire support assembly of claim 12 wherein said receptacle means comprises a resilient notch.

* * * * *